US007797862B2

(12) United States Patent
Daraie et al.

(10) Patent No.: US 7,797,862 B2
(45) Date of Patent: Sep. 21, 2010

(54) EXCAVATOR COUPLER WITH TWO-STAGE LOCK MEMBER

(75) Inventors: Shadruz Daraie, Copley, OH (US); Robert Sikorski, Tallmadge, OH (US)

(73) Assignee: Attachment Technologies, Inc., Cedar Rapids, IA (US)

( * ) Notice: Subject to any disclaimer, the term of this patent is extended or adjusted under 35 U.S.C. 154(b) by 11 days.

(21) Appl. No.: 12/401,275

(22) Filed: Mar. 10, 2009

(65) Prior Publication Data

US 2009/0249661 A1 Oct. 8, 2009

Related U.S. Application Data

(60) Provisional application No. 61/035,132, filed on Mar. 10, 2008.

(51) Int. Cl.
*E02F 3/36* (2006.01)
*E02F 3/96* (2006.01)

(52) U.S. Cl. ..... 37/468; 414/723

(58) Field of Classification Search ..... 37/403, 37/466, 468, 231, 264; 414/723, 724; 403/321, 403/322.1, 31, 323–325; 172/272, 273, 275
See application file for complete search history.

(56) References Cited

U.S. PATENT DOCUMENTS 5,332,353 A * 7/1994 Arnold ..... 414/723
5,382,110 A 1/1995 Perotto et al.
5,549,440 A 8/1996 Cholakon et al.
6,379,075 B1 * 4/2002 Shamblin et al. ..... 403/322.1
6,422,805 B1 7/2002 Miller
6,481,124 B1 11/2002 Miller et al.
6,487,800 B1 * 12/2002 Evans et al. ..... 37/468
6,691,438 B2 2/2004 Fatemi
6,699,001 B2 3/2004 Fatemi
7,306,395 B2 12/2007 Fatemi

* cited by examiner

*Primary Examiner*—Robert E Pezzuto
(74) *Attorney, Agent, or Firm*—Fay Sharpe LLP

(57) ABSTRACT

A coupler for a construction attachment includes a frame including: (i) an upper portion adapted to be secured to an associated excavator; and, (ii) a lower portion adapted to be releasably coupled to a construction attachment. The lower portion of the frame includes a first hook and a second hook. A lock member is movably connected relative to the frame and is movable between an extended position and a retracted position. The first and second hooks include respective open mouths and the lock member obstructs the open mouth of the second hook when the lock member is in the extended position. An actuator is operably connected to the lock member and is adapted to move the lock member between its extended and retracted positions. The lock member slides and pivots sequentially relative to the frame when moved by the actuator from the extended position to the retracted position, and the lock member pivots and slides sequentially relative to the frame when moved by the actuator from the retracted position to the extended position.

16 Claims, 15 Drawing Sheets

EXCAVATOR COUPLER WITH TWO-STAGE LOCK MEMBER

CROSS-REFERENCE TO RELATED APPLICATION

This application claims priority from and benefit of the filing date of U.S. provisional patent application Ser. No. 61/035,132 filed Mar. 10, 2008, and the full disclosure of said provisional patent application Ser. No. 61/035,132 filed Mar. 10, 2008 is hereby expressly incorporated by reference into the present specification.

BACKGROUND

Couplers are known for securing construction attachments such as buckets, impact hammers, shears, etc. fixedly and operatively to the distal end of an arm of a tractor, backhoe, excavator or other type of arm-equipped construction/agricultural equipment. As is generally well known, these couplers, also referred to as "quick couplers," are used as an alternative to a pin-on connection for fixedly and operatively securing an attachment to the distal end of an arm which is, in turn, secured to a boom of a construction/agricultural machine such as a backhoe or excavator.

SUMMARY

In accordance with a first aspect of the present development, a coupler for a construction attachment includes a frame including: (i) an upper portion adapted to be secured to an associated excavator; and, (ii) a lower portion adapted to be releasably coupled to a construction attachment. The lower portion of the frame includes a first hook and a second hook. A lock member is movably connected relative to the frame and is movable between an extended position and a retracted position. The first and second hooks include respective open mouths and the lock member obstructs the open mouth of the second hook when the lock member is in the extended position. An actuator is operably connected to the lock member and is adapted to move the lock member between its extended and retracted positions. The lock member slides and pivots sequentially relative to the frame when moved by the actuator from the extended position to the retracted position, and the lock member pivots and slides sequentially relative to the frame when moved by the actuator from the retracted position to the extended position.

In accordance with another aspect of the present development, a coupler for a construction attachment includes a frame adapted to be releasably coupled to a construction attachment. The frame includes a first hook adapted to receive a first associated attachment pin and a second hook adapted to receive a second associated attachment pin. A lock member is movable relative to the frame between a locked position and an unlocked position. The first and second hooks include respective open mouths and the lock member obstructs said open mouth of the second hook when the lock member is in the locked position. An actuator is operably connected to the lock member and is adapted to move the lock member between its locked and unlocked positions. The lock member first slides linearly and then pivots relative to the frame when moved by the actuator from the locked position to the unlocked position, and the lock member first pivots and then slides linearly relative to the frame when moved by the actuator from the unlocked position to the locked position.

DETAILED DESCRIPTION

Figure 1:
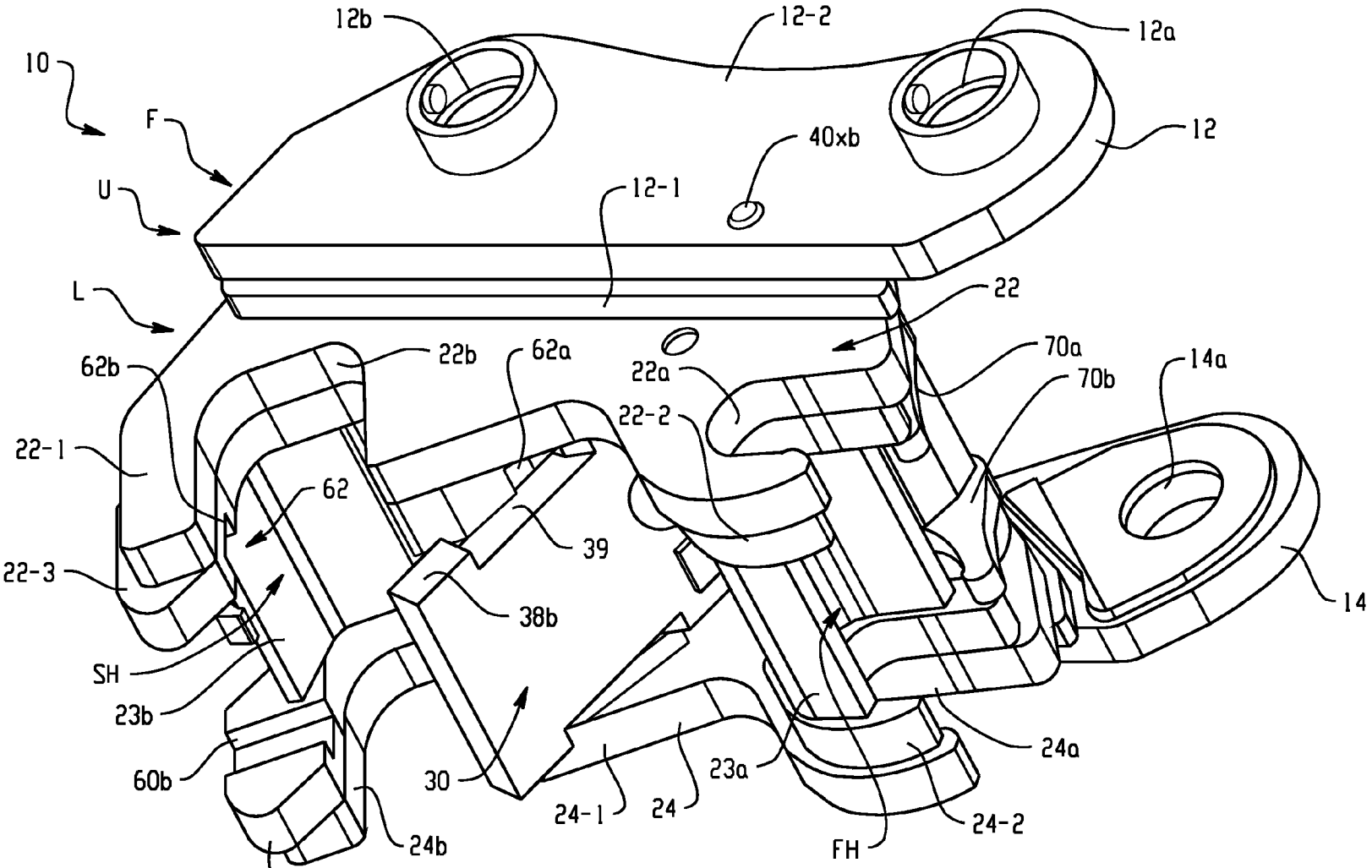
FIGS. 1, 2, and 3 are isometric, left, and right side views, respectively, of a coupler in accordance with the present development.
Figure 2:
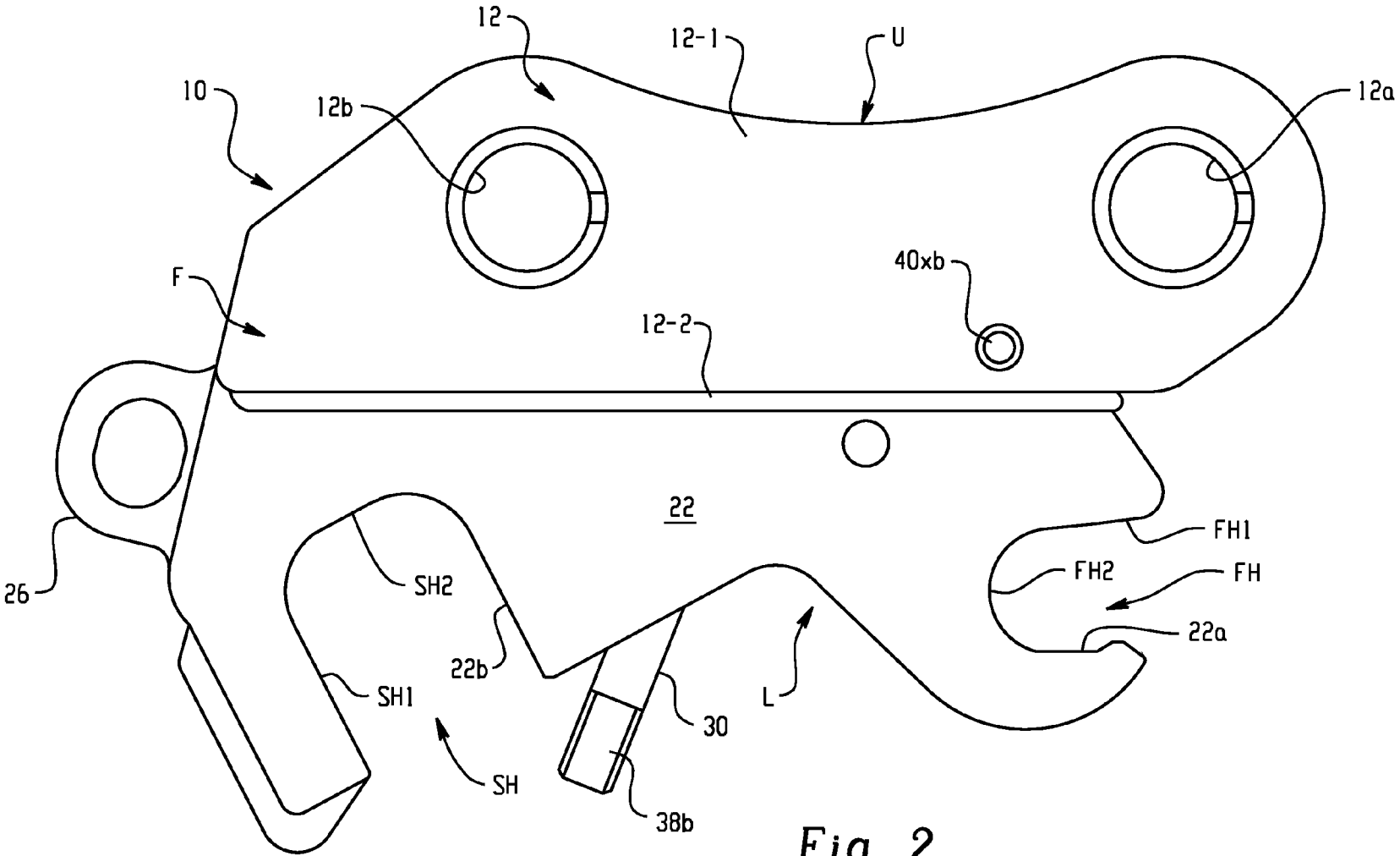
Figure 3:
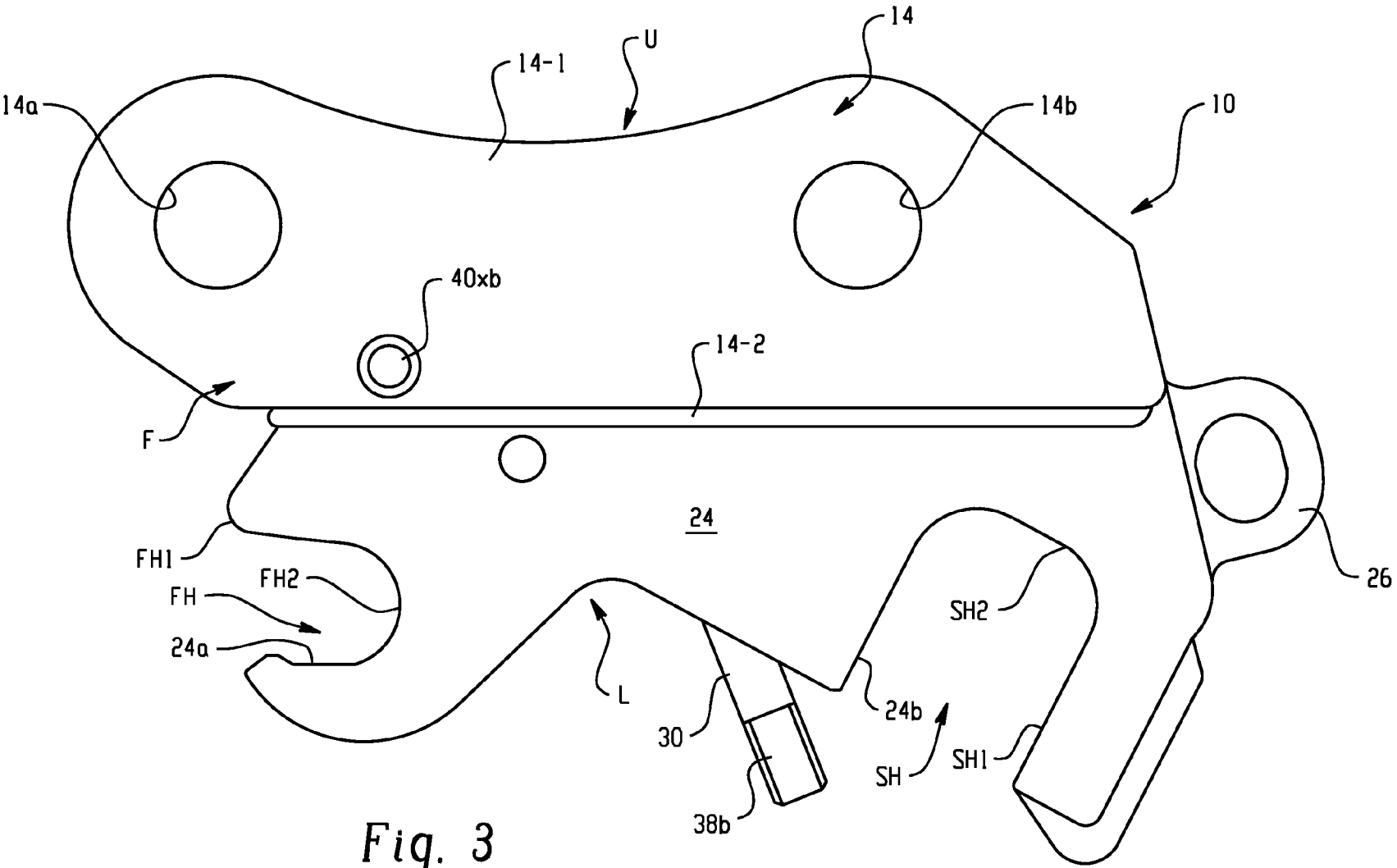

FIGS. 1, 2, and 3 are isometric, left, and right side views, respectively, of a coupler 10 for an excavator, backhoe, or like machine (generally referred to herein as an "excavator") having a boom or arm or "dipper stick" and a control link. The coupler 10 comprises a frame F comprising an upper portion U adapted to be secured to the associated excavator, and a lower portion L adapted to be releasably coupled to a bucket or other attachment having first and second parallel, spaced-apart attachment pins.

More particularly, the upper portion U of the coupler comprises first and second parallel, spaced-part upper ribs 12,14 each comprising first and second apertures 12*a*,12*b* (for the first upper rib 12) and 14*a*,14*b* (for the second upper rib 14). The first apertures 12*a*,14*a* are aligned with each other and the second apertures 12*b*,14*b* aligned with each other. The coupler 10 is adapted to receive the arm and control link of an associated excavator in the channel defined between the upper ribs 12,14, with the excavator arm pivotally secured to the coupler 10 by a first pin received through the excavator arm and the aligned first apertures 12*a*,14*a*, and with the excavator control link pivotally secured to the coupler 10 by a second pin received through the excavator control link and the aligned second apertures 12*b*,14*b*, to secure the coupler 10 operatively to the excavator. The upper ribs 12 and 14 can be one-piece or multi-piece. In the illustrated embodiment, the first and second upper ribs 12,14 are each defined by two plates that are welded or otherwise secured together, i.e., plates 12-1 and 12-2, and plates 14-1 and 14-2.

Figure 10:
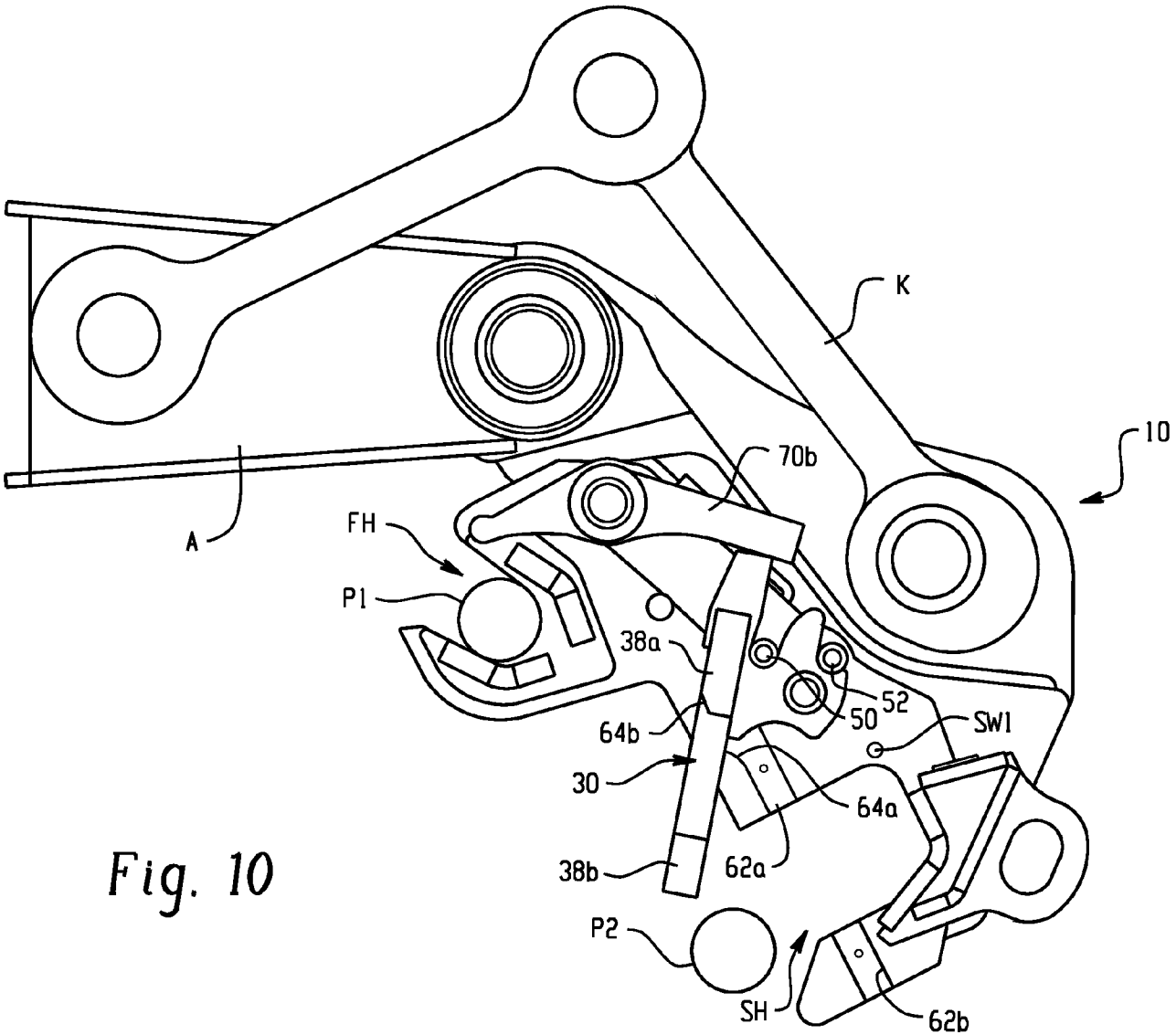

The lower portion L of the coupler 10 is adapted to be releasably coupled to a bucket or other attachment that has parallel, spaced-apart first and second attachment pins P1,P2 (see FIG. 10). Specifically, the lower portion L comprises first and second lower ribs 22,24 that are respectively secured to the first and second upper ribs 12,14. The first and second lower ribs 22,24 each comprise first and second open recesses 22*a*,22*b* (for the first lower rib 22) and 24*a*,24*b* (for the second lower rib 24). The first recesses 22*a*,24*a* open rearwardly and are aligned with each other, and the second recesses 22*b*,24*b* open downwardly and are aligned with each other. The first recesses 22*a*,22*b* cooperate to define a first hook FH adapted to receive the first associated attachment pin P1 (FIG. 10). The second recesses 22*b*,24*b* cooperate to define a second hook SH adapted to receive the second associated attachment pin P2. As shown, one or more first hook plates 23*a* preferably extend between and interconnect the first and second lower ribs 22,24 in the region of the first recesses 22*a*,24*a* and further define the first hook FH. Likewise, one or more second hook plates 23*b* preferably extend between and interconnect the first and second lower ribs 22,24 in the region of the second recesses 22*b*,24*b* and further define the second hook SH. The lower ribs 22,24 can each be one-piece or multi-piece. In the illustrated embodiment, at least adjacent the first and second recesses 22*a*,22*b* and 24*a*, 24*b*, the lower ribs 22,24 preferably further comprise and are defined by inwardly facing rib reinforcement plates 22-2, 22-3 and 24-2, 24-3 that are welded or otherwise secured to respective main plates 22-1, 24-1 to provide added thickness and strength to the lower ribs 22,24 at least in the region of the recesses 22*a*,22*b* and 24*a*,24*b*. The recesses 22*a*,22*b* are defined in both the main plate 22-1 and the rib reinforcement plates 22-2,22-3. The recesses 24*a*, 24*b* are defined in both the main plate 24-1 and the rib reinforcement plates 24-2, 24-3. The frame F typically also includes a lift eye 26 welded or otherwise connected thereto of formed as a part thereof. The frame F and the other coupler components described below are defined from suitable metals, e.g., steel alloys, unless otherwise specified.

The first hook FH includes an open mouth FH1 oriented rearwardly and a closed inner region FH2. The second hook SH includes an open mouth SH1 and a closed inner end SH2. The open mouth SH1 of the second hook is oriented downwardly and transversely relative to the open mouth FH1 of the first hook. As is generally known in the art, this relative transverse arrangement of the mouth of the second hook SH relative to the mouth of the first hook FH ensures that the first attachment pin P1 must be received in the first hook FH before the second attachment pin P2 is received in the second hook SH during attachment coupling, and conversely ensures that during decoupling, the second attachment pin P2 must be withdrawn from the second hook SH before the first attachment pin P1 can be withdrawn from the first hook.

The coupler 10 further comprises a lock wedge or lock member 30 located between the first and second lower ribs 22,24 and movable relative to lower ribs between a retracted or unlocked position (FIGS. 1-3) where it is retracted so not to block the mouth SH1 of the second hook SH to allow insertion and withdrawal of the second attachment pin P2, and an extended or locked position (FIG. 7) where it blocks the mouth SH1 and captures the second attachment pin P2 in the second hook SH. The lock member 30 is typically a multi-piece welded assembly, but it can alternatively be a one-piece construction defined by a casting or the like.

Figure 4A:
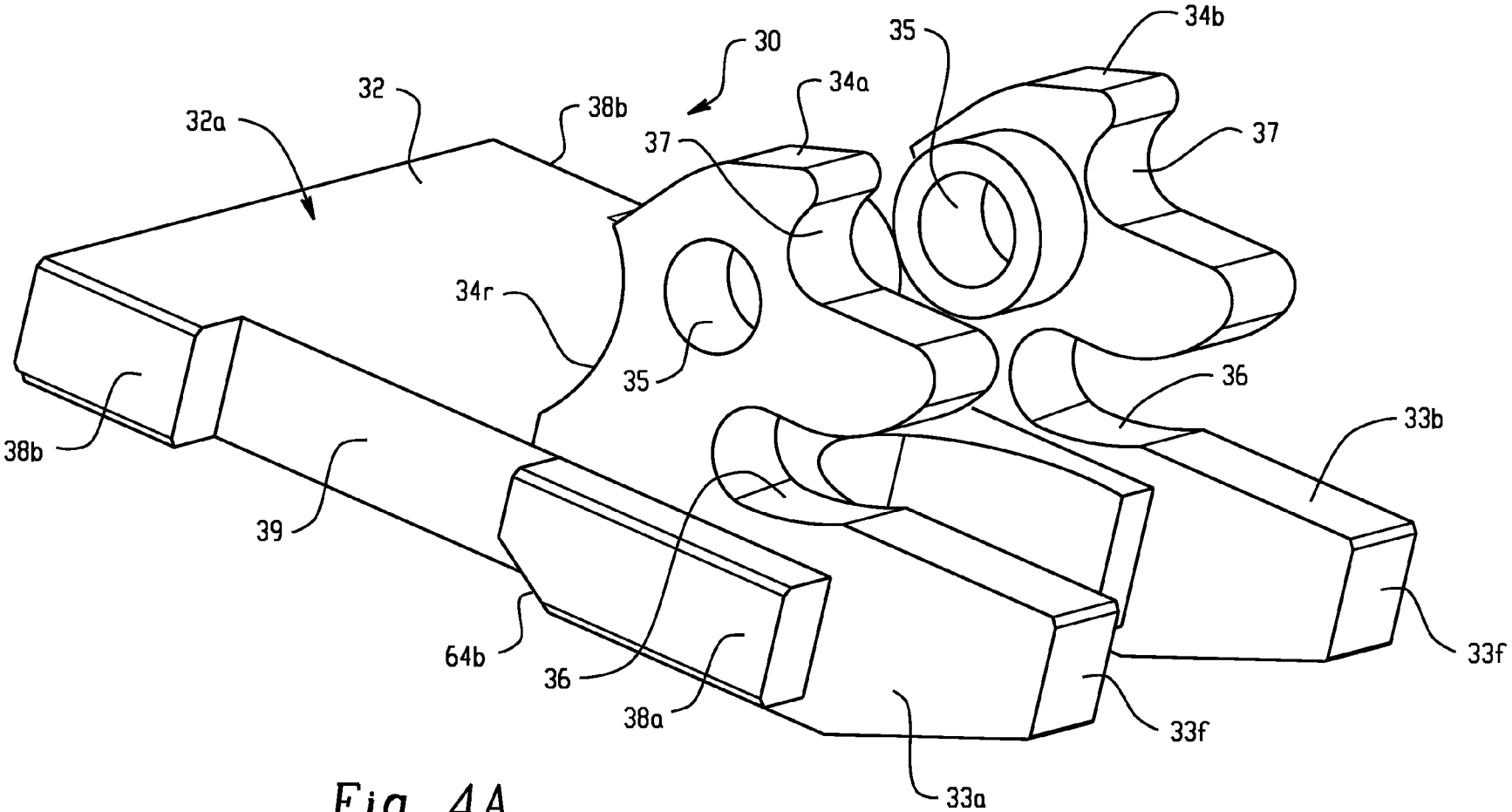
FIGS. 4A and 4B show the lock member of the coupler by itself.
Figure 4B:
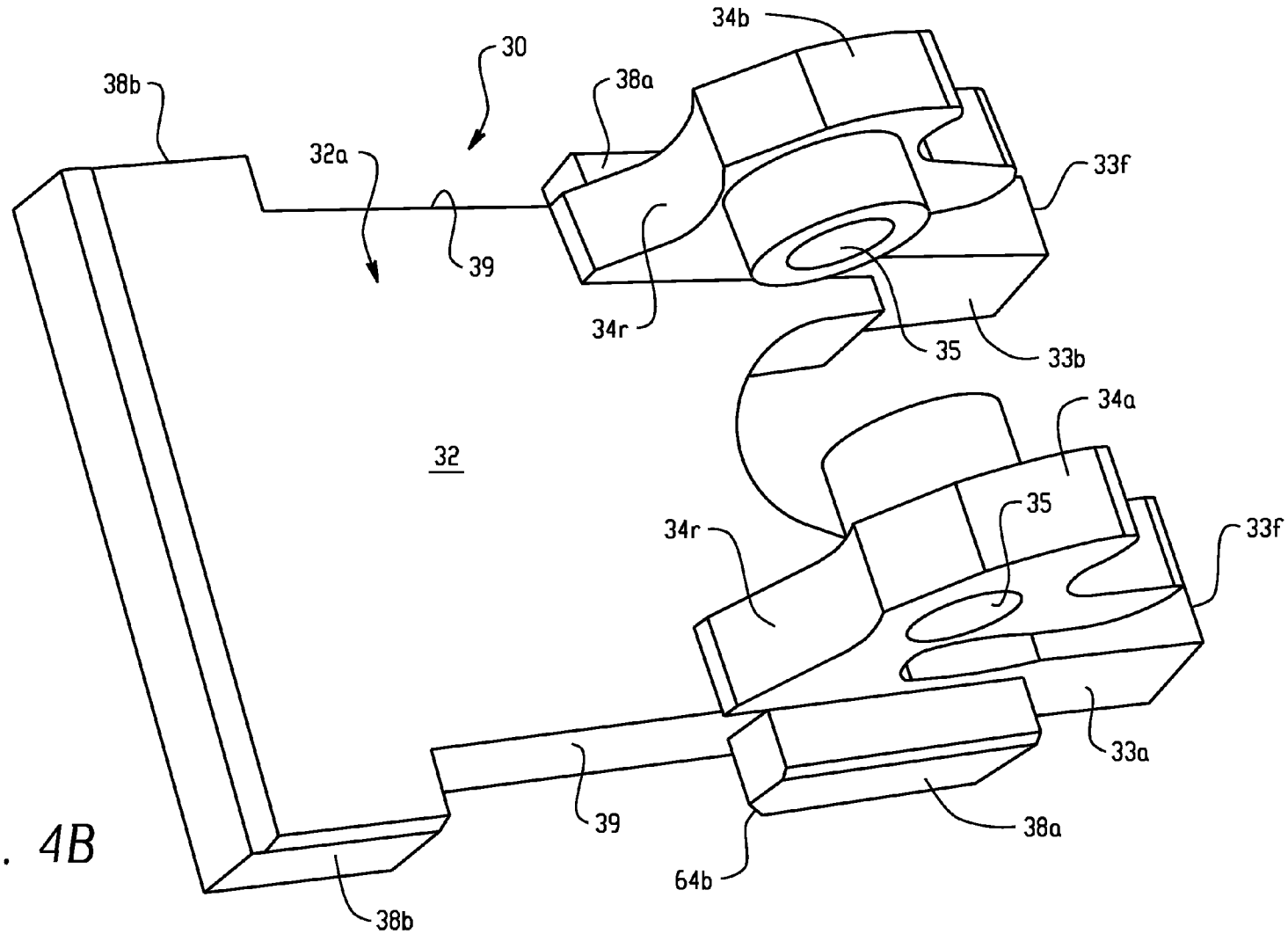

The lock member 30 is shown by itself in FIGS. 4A and 4B and comprises a body 32 having at least one and preferably first and second parallel cam plates 34*a*,34*b* connected thereto or defined as a part thereof. The body 32 comprises a head portion 32*a* that projects forward from the cam plates 34*a*,34*b*, and first and second tail portions 33*a*,33*b* that project rearwardly from the cam plates 34*a*,34*b*. The cam plates 34*a*,34*b* define respective cross-pin apertures 35 that are aligned with each other. The cam plates also define respective matching curved or contoured cam slots 36 and matching pivot recesses 37. The opposite first and second lateral sides of the lock member 30 body 32 each comprises first and second tabs 38*a*,38*b* separated by a gap 39. Each tail portion 33*a*,33*b* comprises a lock face 33*f*. Each cam plate 34*a*,34*b* also defines a pin seating recess 34*r* adapted to mate with a second attachment pin seated in the second hook SH of the coupler 10.

Figure 5A:
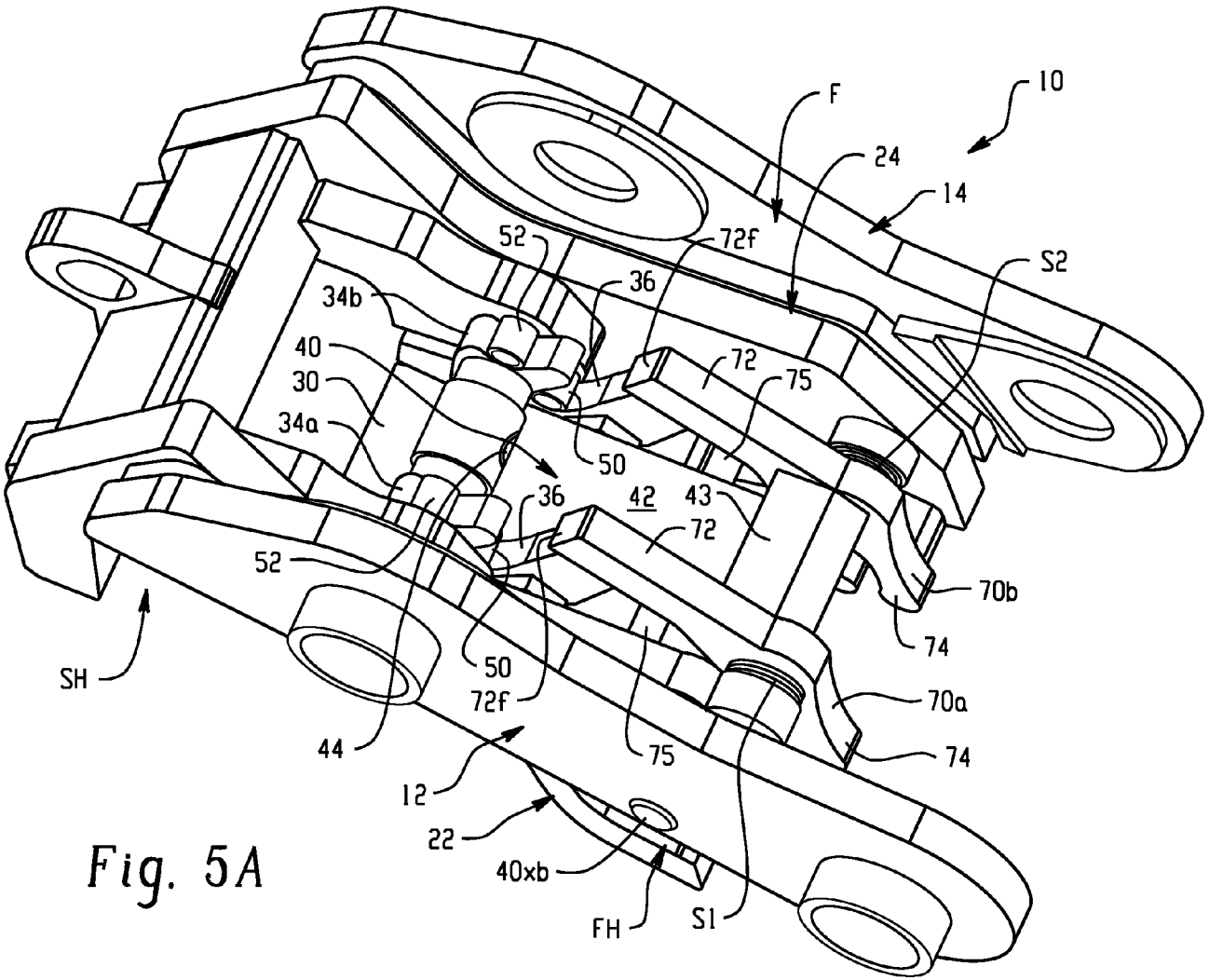
FIGS. 5A and 5B are additional isometric views of the coupler of FIGS. 1-3, with the lock member removed from the view of FIG. 5B to reveal other components and structures.
Figure 5B:
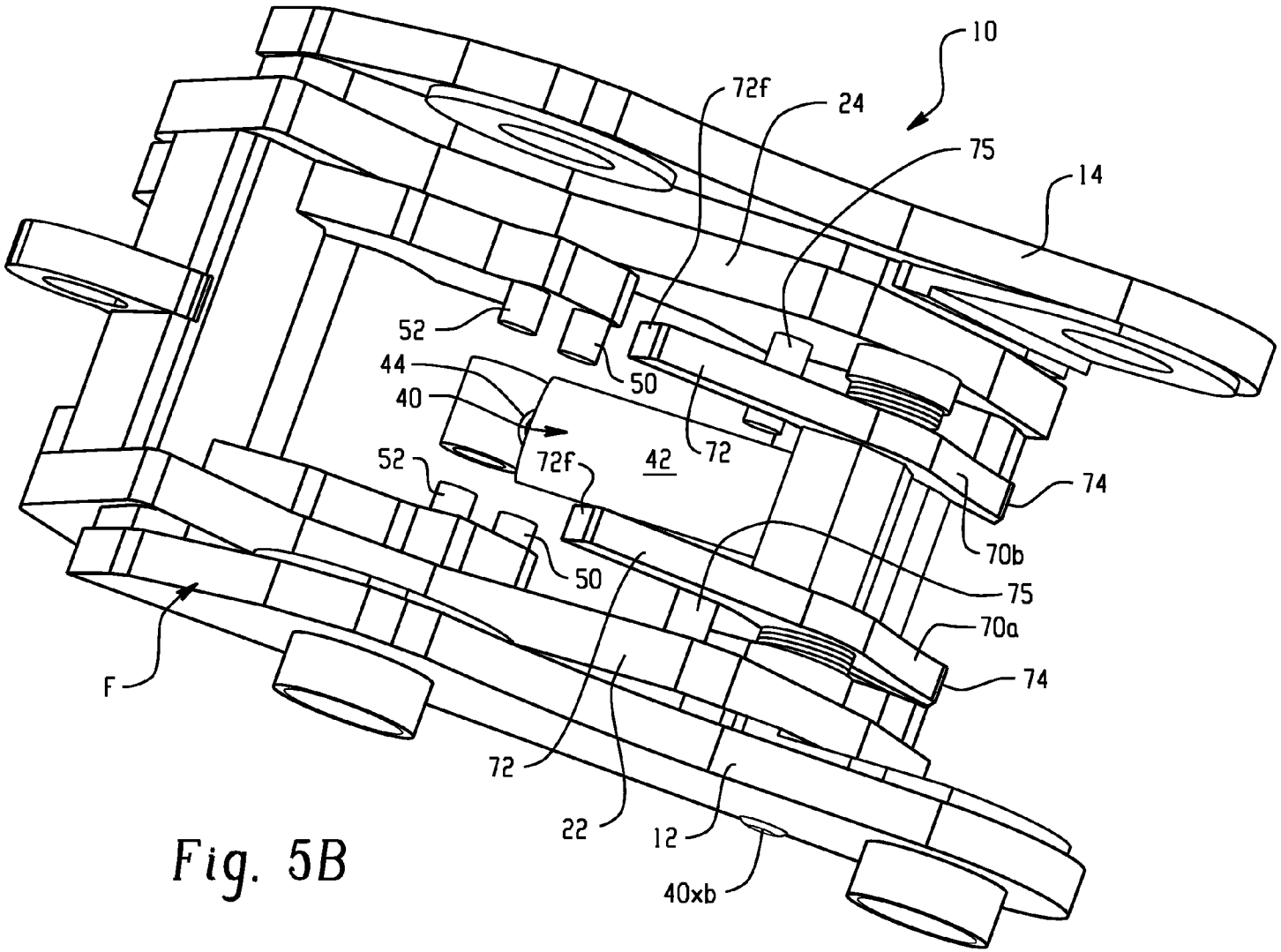
Figure 6A:
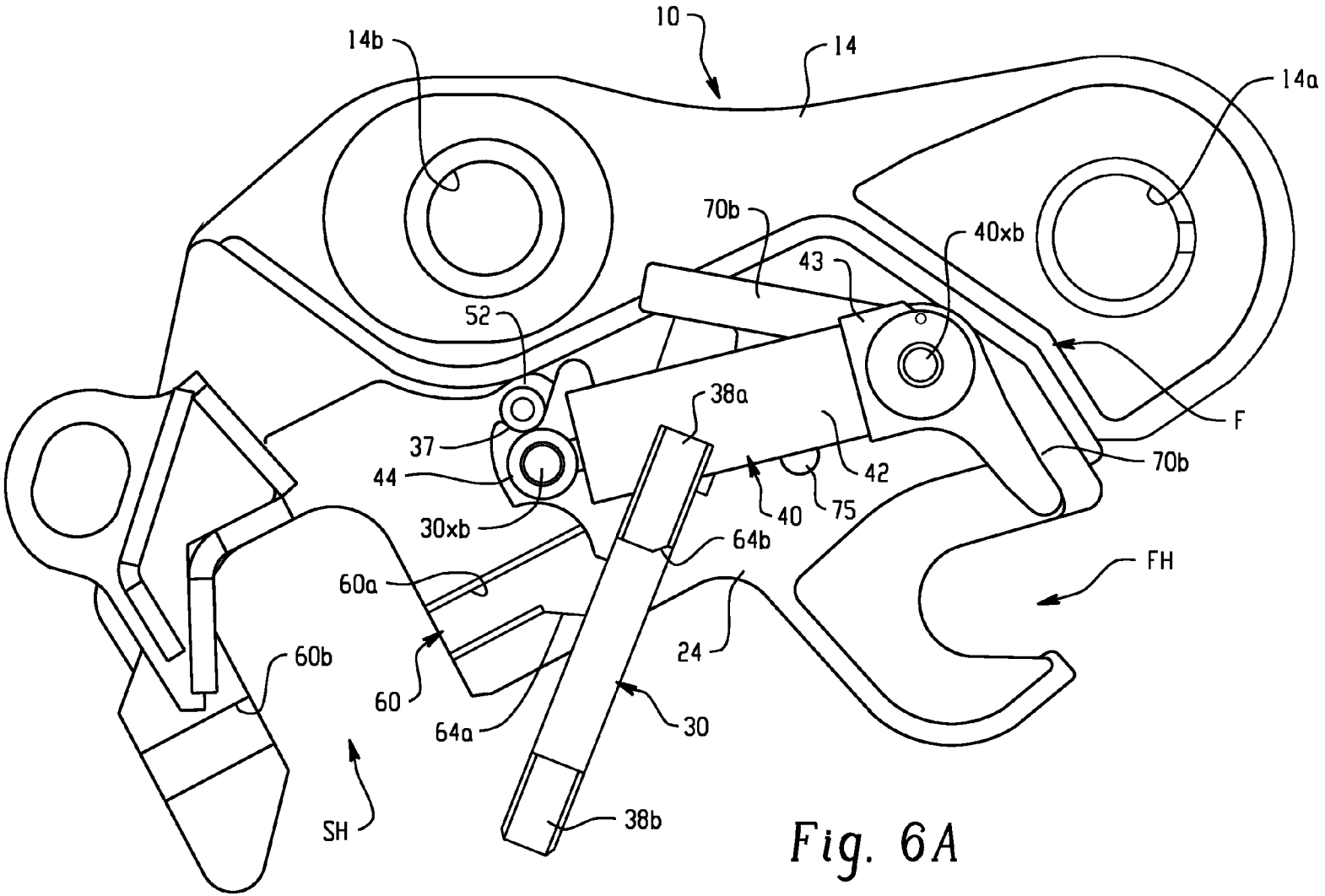
FIG. 6A is a left side view similar to FIG. 2, but has the first upper and lower ribs and other structures removed to reveal additional structure and components.
Figure 6B:
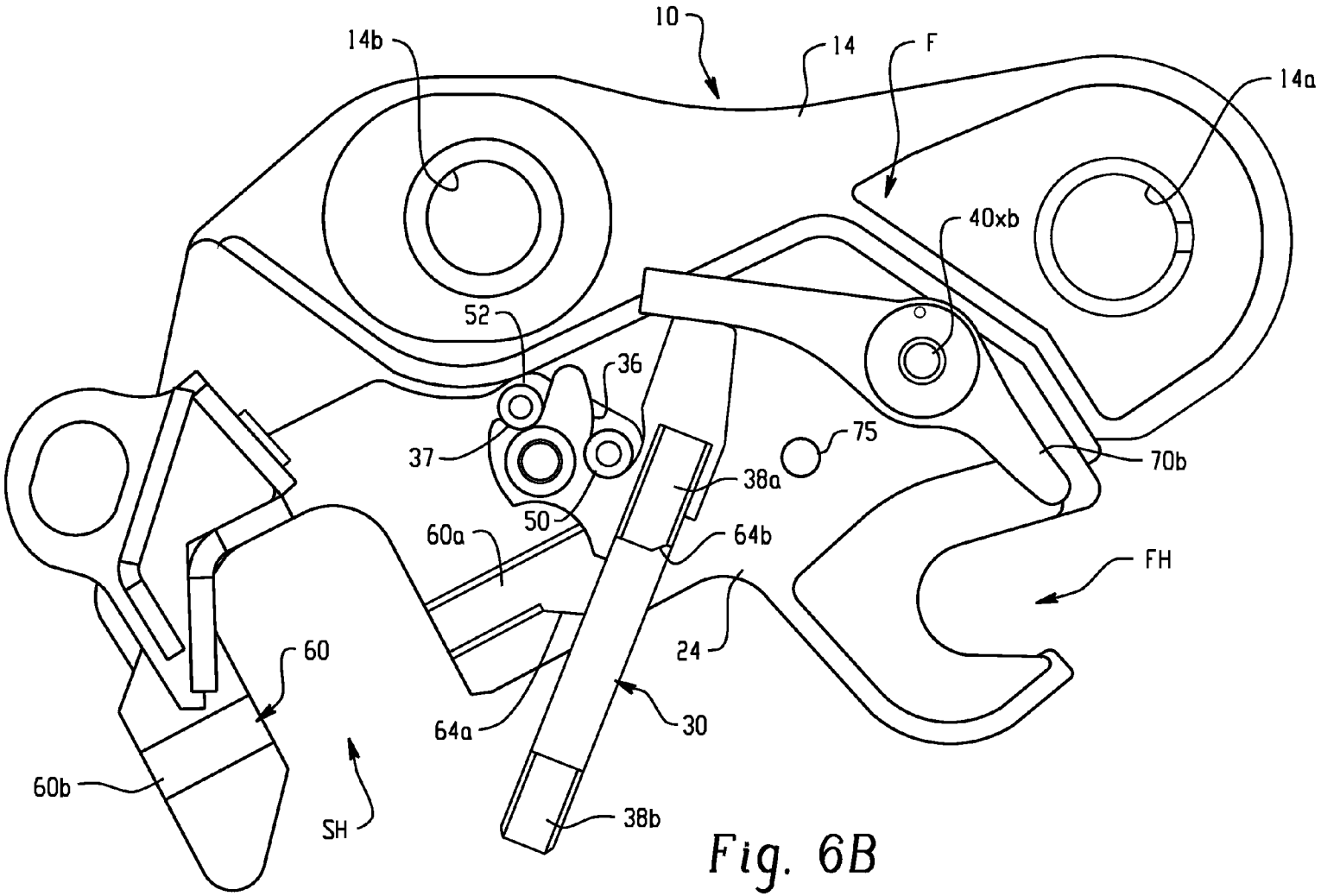
FIG. 6B is similar to FIG. 6A except that the hydraulic cylinder actuator is omitted to reveal additional structures and components.

FIGS. 5A and 5B are isometric views of the coupler 10, with the lock member 30 removed from the view of FIG. 5B to reveal other components. FIG. 6A is a left side view similar to FIG. 2, but having the first upper and lower ribs 12,22 and other components removed. In FIGS. 5A, 5B and 6A, it can be seen that the coupler 10 further comprises an actuator 40 operatively connected between the frame F and the lock member 30 and adapted to move the lock member 30 selectively to and between its locked and unlocked positions and to hold the lock member 30 in either the locked or unlocked position. FIG. 6B is identical to FIG. 6A, but the hydraulic cylinder actuator 40 is removed to reveal other components. In the illustrated embodiment, the actuator comprises a hydraulic cylinder having a body 42 anchored to the frame F and a selectively extensible and retractable rod 44 that is operatively coupled to the lock member 30. Cylinder rod 44 extends and retracts in a linear manner along a cylinder rod axis. As shown, a lock member cross-pin 30*xb* (FIG. 6A) is located in and extends between the cross-pin apertures 35, and also extends through an eye or other portion of the rod 44 that is located between the cam plates 34*a*,34*b* of the lock member 30 so as to provide a pivoting coupling between the rod 44 and the lock member 30. Similarly, the hydraulic cylinder body 42 includes a base 43 that is pivotally connected to the frame F by a cylinder cross-pin 40*xb* that passes through the cylinder base 43 and that extends between and is connected to the frame F. The cylinder body 42 is pressurized to extend or retract the rod 44 with hydraulic fluid supplied from the hydraulic system of the associated excavator through extend and retract ports, respectively.

As shown in FIGS. 6A and 6B, second lower rib 24 comprises a lock member slot 60. The lock member slot 60 comprises an inner portion 60*a* located on an inner side of the second hook SH and an outer portion 60*b* located on an outer side of the second hook SH. As can be seen in FIGS. 1 and 10, the first lower rib 22 also defines a lock member slot 62 that matches and is aligned with the lock member slot 60 of the second lower rib 24. The lock member slot 62 comprises an inner portion 62*a* located on an inner side of the second hook SH and an outer portion 62*b* located on an outer side of the second hook SH.

When the lock member 30 is in its extended/locked position (FIG. 7), the opposite first tabs 38*a* of the lock member 30 are slidably received in the inner slot portions 60*a*,62*a*, and the opposite second tabs 38*b* of the lock member 30 are slidably received in the outer slot portions 60*b*,62*b*. When the lock member 30 is in its retracted/unlocked position (FIGS. 1, 6A, 6B, 10), the tabs 38*a*,38*b* of the lock member 30 are withdrawn from the respective slots 60*a*,60*b*,62*a*,62*b* as shown. As will be explained in further detail below, the locked position of the lock member 30 in the slots 60,62 is variable depending on the spacing or spread between the first and second attachment pins P1,P2.

Figure 10A:
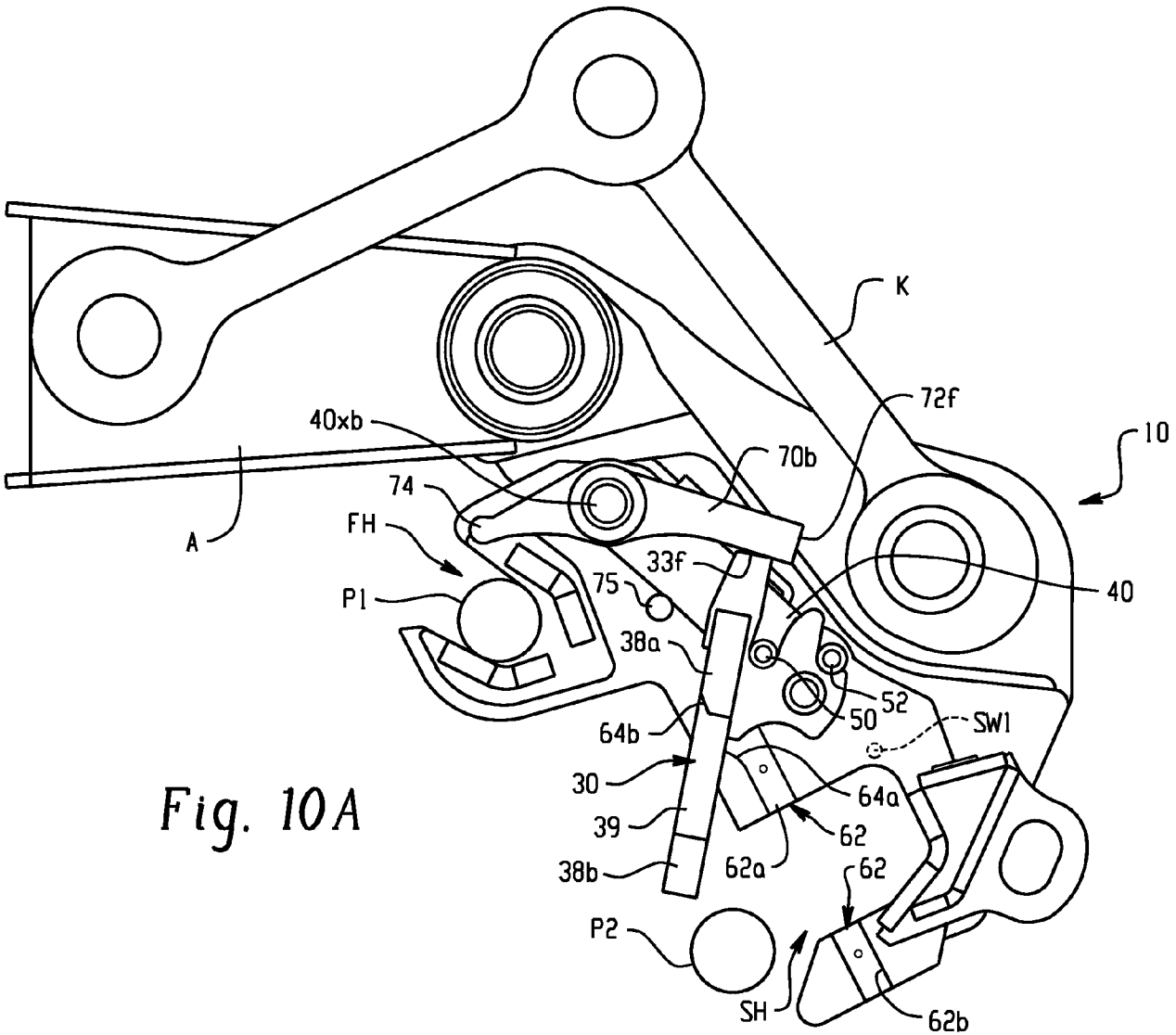

Those of ordinary skill in the art will recognize that when the lock member 30 is moved from its locked position (FIGS. 7 & 7A) to its unlocked position by retraction of the cylinder rod 44, it first slides linearly as it moves in the slots 60,62, and then pivots to its unlocked position (FIGS. 10 & 10A) by pivoting about the lock member cross-pin 30*xb*. This two-stage sequential movement of the lock member is explained further now with reference also to FIG. 5B (with the lock member 30 is removed from the view for clarity), where it can be seen that the first and second lower ribs 22,24 each comprise first and second lock member bosses 50,52 projecting inwardly toward each other. The first lock member bosses 50 are aligned with each other, and the second lock member bosses 52 are aligned with each other. As shown in FIG. 5A, the first lock member bosses 50 are adapted to be slidably received in the respective cam slots 36 of the cam plates 34*a*,34*b* when the lock member 30 is retracted sufficiently by the actuator 40. Also, the second lock member bosses 52 are seated in the respective pivot recesses 37 of the cam plates when the lock member 30 is retracted sufficiently by the actuator 40. It will be recognized that when the bosses 50,52 move into the cam slots 36 and pivot recess 37, further attempted retraction of the lock member 30 by the actuator 40 will cause the lock member 30 to pivot about the cross-pin 30*xb* to its illustrated unlocked position owing to the contour of the cam slots 36. Specifically, the seating of the second bosses 52 in the pivot recesses 37 and receipt of the first bosses 50 into the contoured cam slots 36 causes the lock member 30 to pivot to its unlocked position about the cross-pin 30*xb*. The gap 39 between the tabs 38*a*,38*b* on the opposite lateral sides of the lock member 30 allows the lock member to pivot without being obstructed by portions of the lower ribs 22,24 that partially define the inner portions 60*a*,62*a* of the lock member slots 60,62.

When the actuator 40 is operative to move the lock member 30 from its unlocked position to its locked position, the opposite sequence of lock member movements takes place, with the lock member 30 first pivoting about the cross-pin 30*xb* in the opposite direction due to contact between the cam plates 34*a*,34*b* of the lock member 30 and the bosses 50,52. When the lock member 30 has pivoted sufficiently so that it becomes disengaged from the bosses 50,52 and so that the tabs 38*a*,38*b* on its opposite sides become aligned with their respective lock member slots 60, further extension of the cylinder rod 44 will cause the lock member 30 to slide forward or extend so that the tabs 38*a*,38*b* on its opposite lateral sides move into their respective lock member slot portions 60*a*,62*a* and 60*b*, 62*b* and so that the lock member 30 spans the open mouth SH1 of the second hook SH. An innermost end of the inner slot portions 60*a*,62*a* includes a bevel surface 64*a* (FIGS. 6A, 6B, 10), and the tabs 38*a* of the lock member 30 include a matching bevel surface 64*b*, and sliding engagement of the bevel surfaces 64*a*,64*b* guides the lock member tabs 38*a* into the inner slot portions 60*a*,60*b* and thus facilitates alignment of the lock member tabs 38*b* with their respective outer slot portions 60*b*,62*b*.

Figure 8:
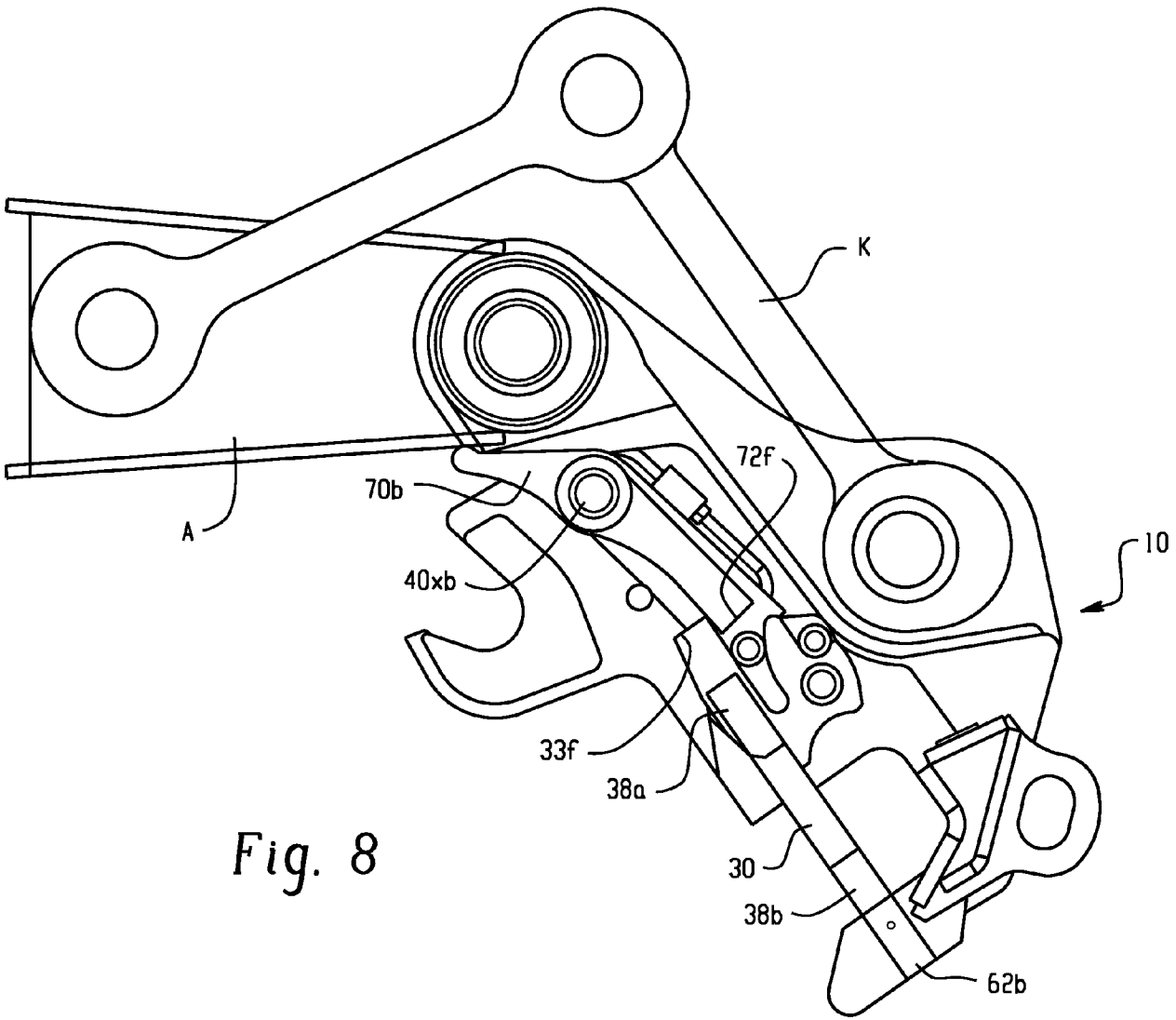
Figure 9:
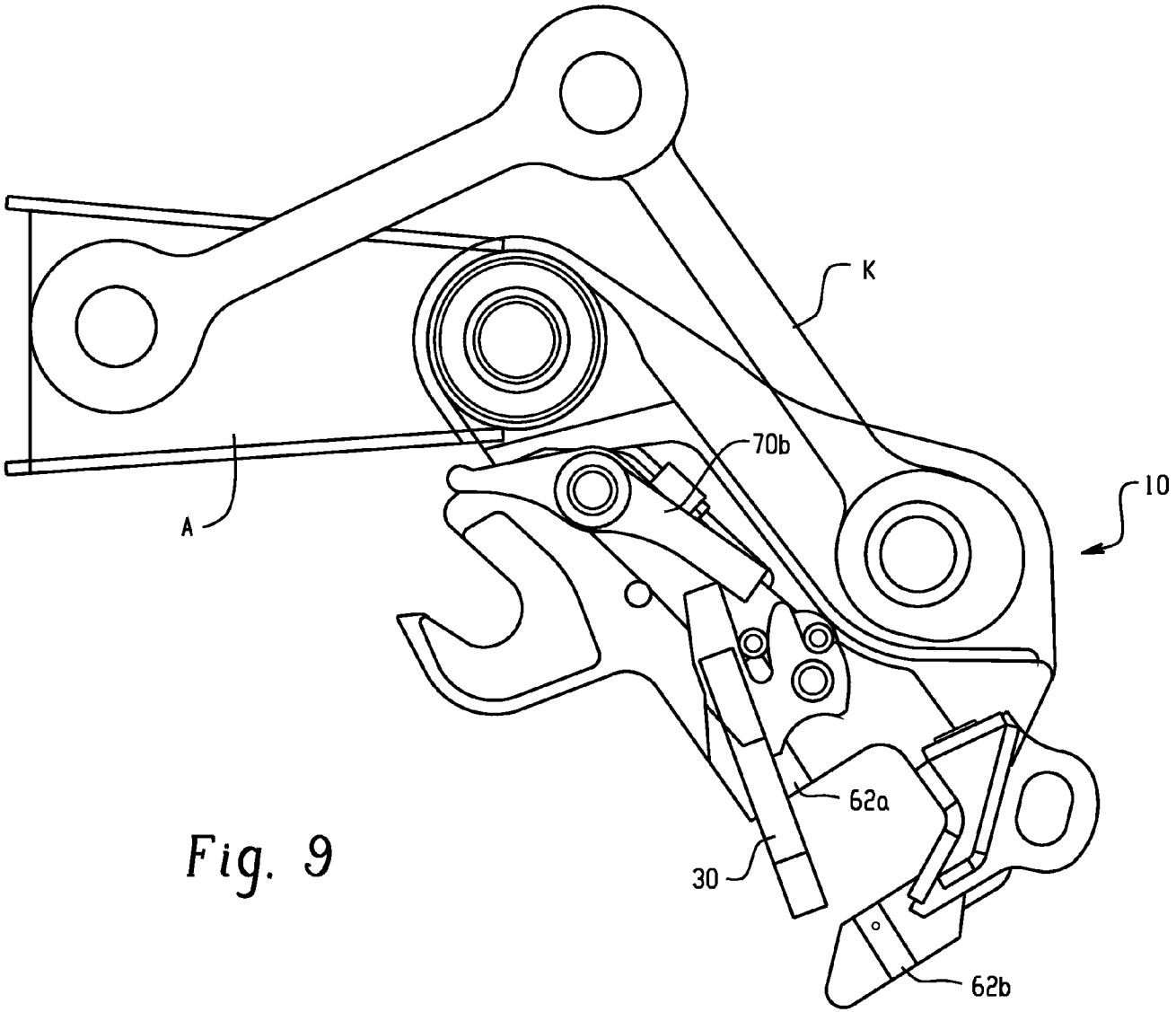

The coupler 10 further comprises at least one supplemental lock bar that selectively blocks movement of the lock member 30 from its locked position to its unlocked position. As shown, the coupler 10 comprises first and second lock bars 70*a*,70*b* located respectively adjacent the first and second lower ribs 22,24. Each lock bar is pivotally connected relative to the coupler frame F, e.g., pivotally mounted on the cylinder cross-pin 40*xb* on opposite sides of the cylinder base 43. The lock bars 70*a*,70*b* move between a down or locked position (FIG. 7) and an up or unlocked position (FIGS. 8-10). When the lock bars 70*a*,70*b* are in the locked position, they block movement of the lock member 30 from its locked position to its unlocked position. When the lock bars 70*a*,70*b* are in the unlocked position, they are located so as not to block movement of the lock member 30 from its locked position to its unlocked position.

Each lock bar 70*a*,70*b* comprises a first end 72 comprising a lock face 72*f* and an opposite, second end 74. The lock bars 70*a*,70*b* are pivotally connected to the coupler frame F between their first and second ends 72,74. The second ends 74 of the lock bars 70*a*,70*b* project outwardly from the coupler frame F in the region between the first hook FH and the first (excavator arm pin-on) apertures 12*a*,14*a* of the upper portion U. The first ends 72 of the lock bars are located near the lock member 30 and, as described below, the lock faces 72*f* thereof selectively engage the lock faces 33*f* of the lock member to block movement of the lock member 30 from its locked position to its unlocked position.

FIGS. 7, 7A, 8-10, and 10A are right side views of the coupler 10, with the right ribs and other components removed to show further structure and operation of the coupler 10. Only the lock bar 70*b* is visible, but the other lock bar 70*a* is structured and functions in a corresponding manner. The coupler 10 is shown as being connected by pin-on connections to an arm A and control link K of an associated excavator.

Figure 7:
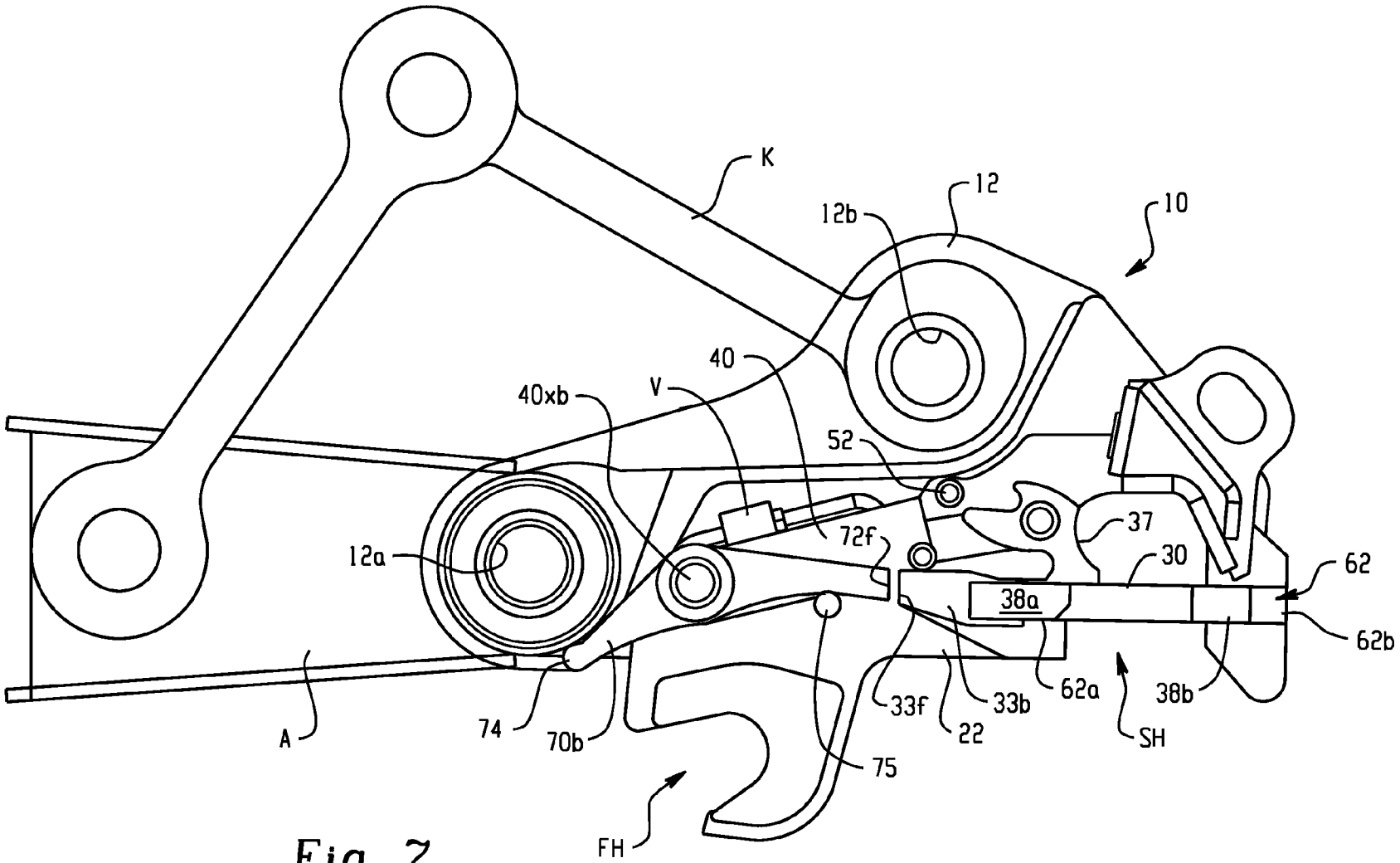
FIGS. 7, 7A, 8-10, and 10A are right side views of a coupler in accordance with the present development, with the right ribs and other components removed to show further structure and operation of the coupler.
Figure 7A:
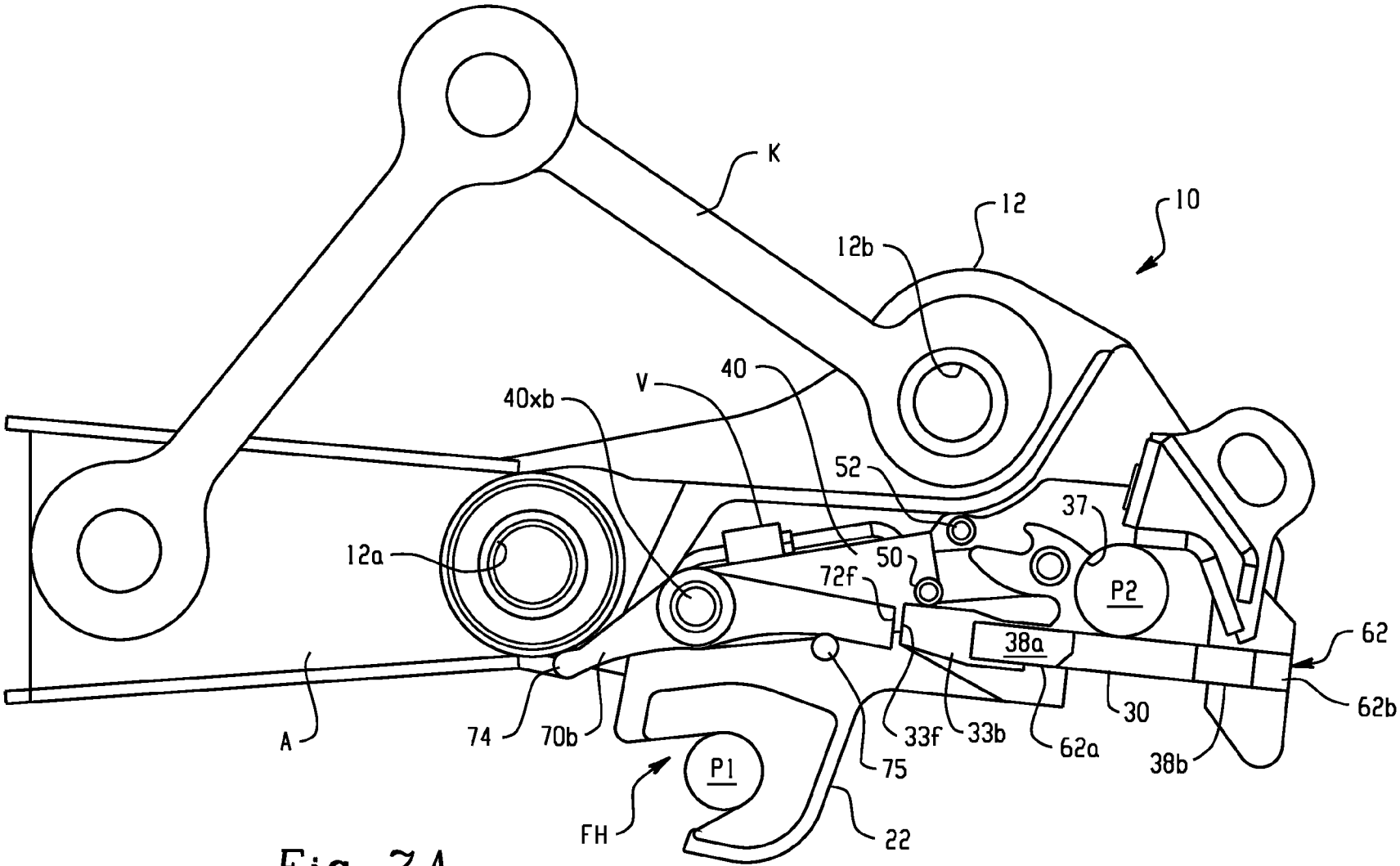

FIGS. 7 & 7A show the coupler 10 with the lock member 30 in a extended/locked position. It should be recognized that the locked position of the lock member will vary somewhat depending upon the distance or spread between the attachment pins P1,P2. In all cases, however, the lock member 30 is captured in the slots 60,62 when in its locked position, with the tabs 38*a*,38*b* on both lateral sides of the lock member 30 slidably located in the respective slot portions 60*a*,60*b* and 62*a*,62*b*. It can be seen that the lock bar 70*b* is located in its locked position so that the lock face 72*f* is aligned with the lock face 33*f* of the lock member 30. If the hydraulic cylinder or other actuator 40 is operated to retract the lock member from its locked position toward its unlocked position (to the left in FIGS. 7-10), the lock face 33*f* of the lock member 30 will abut the lock face 72*f* of the lock bar 70*b* and the lock member 30 will be blocked from any further movement toward its unlocked position. The abutting lock faces 33*f*,72*f* are shaped and arranged so that the lock member 30 urges the lock bar 70*b* toward its locked position upon contact therewith. The coupler 10 comprises first and second lock bar stops 75 (FIGS. 5A, 5B) connected to first and second lower ribs 22,24 of the frame F, and the first and second lock bars 70*a*,70*b* respectively abut the first and second stops 75 to define the locked position of the lock bars 70*a*,70*b*. The lock bars 70*a*,70*b* are spring-biased into the locked position against the stops 75. For this purpose, the coupler 10 comprises torsion springs S1,S2 (see FIGS. 5A and 5B) or the like connected between each lock bar 70*a*,70*b* and an anchor point connected to the frame F. Stop 75 shown in FIGS. 7-10 is connected to the lower rib 24 of the coupler frame F, but the rib 24, itself, is not shown in FIGS. 7-10.

With continuing reference to FIGS. 7-10A, operation of the coupler 10 is explained. FIGS. 7 & 7A show the coupler 10 with the lock member 30 in a locked position, wherein the lock member 30 is captured in the lock member slots 60,62 as described above and completely spans and blocks the mouth SH1 of the second hook SH. The ends 74 of the lock arms 70*a*,70*b* are shown to be in sliding contact with the excavator arm A but the lock arms 70*a*,70*b* remain in the locked position because the coupler 10 is not curled sufficiently to cause the arm A to pivot the lock arms 70*a*,70*b*.

FIG. 8 shows the coupler 10 curled sufficiently relative to the excavator arm A so that the coupler 10 is located at an angular position relative to the arm A where the second end 74 of the lock arms 70*a*,70*b* are pushed inward/downward by contact with the arm A which, in turn, causes the lock arms 70*a*,70*b* to pivot to their unlocked positions where the lock faces 72*f* of the lock arms are moved out of alignment with the lock faces 33*f* of the lock member 30, As such, the lock member 30 can move from the position shown in FIG. 7 further toward its unlocked position under force of the hydraulic cylinder or other actuator 40. In FIG. 8, forward tabs 38*b* of the lock member 30 are just withdrawn the forward slot portions 60*b*,62*b*, and the rear tabs 38*a* of the lock member are just minimally still engaged with the inner slot portions 61*a*,62*a*.

FIG. 9 shows further retracting movement of the lock member 30 toward its unlocked position where it begins to pivot due to the engagement of the cam plates 34*a*,34*b* with the lock member bosses 50,52. FIG. 10 shows the lock member 30 moved fully to its retracted/unlocked position. It should be noted in FIGS. 9 and 10, that the tail portions 33*a*,33*b* of the lock member 30 engage and pivot the lock bars 70*a*,70*b* further away from their locked positions against the force of the biasing springs S1,S2 when the lock member 30 moves to its unlocked position. This is preferred because it limits the amount of pivoting of the lock bars 70*a*,70*b* that must be performed by contact between the lock arms 70*a*,70*b* and the excavator arm A, i.e., contact between the second end 74 of the lock arms 70*a*,70*b* and the excavator arm A is sufficient to move the lock arms 70*a*,70*b* to their unlocked positions, but is not required to move the lock arms 70*a*,70*b* fully to the position shown in FIGS. 10 & 10A which would be difficult due to the lack of clearance between the excavator arm A and the coupler 10. In other words it might not be possible to curl the coupler 10 sufficiently relative to the excavator arm A to move the lock arms 70*a*,70*b* to the position shown in FIGS. 10 & 10A which is required for full retraction/unlocking of the lock member 30, so the lock member 30 is used to push the lock arms 70*a*,70*b* to the required position to accommodate movement of the lock member 30 to its unlocked position.

Of course, when the actuator 40 is used to move the lock member 30 from its unlocked position (FIGS. 10 & 10A) to a locked position (FIGS. 7 & 7A), the lock arms 70*a*,70*b* automatically pivot to their locked positions against stops 75 as shown in FIG. 7 under force of springs S1,S2 as soon as the lock member 30 is moved sufficiently toward the locked position so that it no longer obstructs such return movement of the lock arms.

The coupler 10 can further comprise an electrical switch SW1 (FIGS. 10 & 10A) connected to the frame F and adapted to sense the position of the lock member 30 (or another component) to indicate when the lock member 30 is (or is not) in its locked position. The switch SW1 can be a contact or non-contact switch, e.g., a reed switch or Hall-effect sensor, located to be tripped when the lock member 30 moves to/from its locked position. The switch SW1 outputs a signal that can be used, e.g., by a control system of the excavator, to "numb" or completely disable the excavator in the event the lock member 30 moves out of its locked position at an unexpected time, i.e., when the coupler 10 is not curled sufficiently relative to the excavator arm A to prevent dropping of the attachment even if the lock member 30 is unlocked. Alternatively or additionally, the actuator 40 can include the switch SW1 in or near the actuator 40 so as to sense the position of the rod 44 for the same purpose and result.

Also, the hydraulic cylinder actuator 40 is equipped with a pilot check valve V (FIG. 7) that prevents retraction of the rod 44 into the housing 42 in the absence of sufficient hydraulic fluid pressure being supplied to the retract port of the cylinder 40, i.e., the pilot check valve prevents retraction of the rod 44 simply due to loss of pressure at the extend side of the hydraulic cylinder 40 so that the retract side of the cylinder must be actively pressurized (and the extend side allowed to evacuate) in order for the rod 44 to move the lock member 30 from its locked position to its unlocked position.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

The invention claimed is:

1. A coupler for a construction attachment, said coupler comprising:

a frame comprising: (i) an upper portion adapted to be secured to an associated excavator; and, (ii) a lower portion adapted to be releasably coupled to a construction attachment;

said lower portion of said frame comprising a first hook and a second hook;

a lock member movably connected relative to the frame, said lock member movable between an extended position and a retracted position, said first and second hooks including respective open mouths and said lock member obstructing said open mouth of said second hook when said lock member is in said extended position;

an actuator operably connected to the lock member and adapted to move the lock member between its extended and retracted positions;

wherein said lock member slides and pivots sequentially relative to said frame when moved by said actuator from said extended position to said retracted position; and, wherein said lock member pivots and slides sequentially relative to said frame when moved by said actuator from said retracted position to said extended position.

2. The coupler as set forth in claim 1, wherein said lock member comprises:

a body including opposite first and second lateral sides, each of said first and second lateral sides comprising first and second tabs separated from each other by a gap, wherein said gap on each of said first and second lateral sides provides clearance for a portion of said frame during pivoting movement of said lock member relative to said frame.

3. The coupler as set forth in claim 2, wherein said frame comprises first and second lock member slots located on opposite first and second lateral sides of said lower portion of said frame, said first and second lock member slots comprising: (i) respective inner portions located opposite each other on an inner side of said open mouth of said second hook; and, (ii) respective outer portions located opposite each other on an outer side of said open mouth of said second hook.

4. The coupler as set forth in claim 3, wherein said opposite first tabs of said lock member are seated in said opposite inner portions of said lock member slot and said opposite second tabs of said lock member are seated in said opposite outer portions of said lock member slot when said lock member is in its extended position.

5. The coupler as set forth in claim 4, wherein said lock member further comprises at least one cam plate, wherein said lock member pivots relative to said frame in response to said cam plate contacting said frame during movement of said lock member between its locked and unlocked positions.

6. The coupler as set forth in claim 5, wherein said lock member is pivotally connected to said actuator by a cross-pin, and wherein said lock member pivots about said cross-pin in response said actuator acting on said lock member when said at least one cam plate is in contact with said frame.

7. The coupler as set forth in claim 6, wherein said cam plate comprises at least one curved cam slot and wherein said coupler frame comprises a first boss that is received in said curved cam slot when said lock member is located in said retracted position, wherein movement of said curved cam slot relative to said first boss guides pivoting movement of said lock member during movement of said lock member from said extended position to said retracted position and vice versa.

8. The coupler as set forth in claim 7, wherein said first boss is spaced from said curved cam slot when said lock member is in its locked position.

9. The coupler as set forth in claim 8, further comprising:

a pivot recess defined in said cam plate;

a second boss connected to said frame;

said lock member pivoting about said cross-pin in response to said second boss being received in said pivot recess and abutted with said cam plate when said actuator is acting on said at least one cam plate.

10. The coupler as set forth in claim 5, wherein said lock member comprises first and second spaced-apart cam plates.

11. The coupler as set forth in claim 1, further comprising:

at least one supplemental lock bar pivotally connected to said frame and movable between a locked position and an unlocked position, wherein said at least one supplemental lock bar blocks movement of the lock member from said extended position to said retracted position when said at least one supplemental lock bar is in its locked position, said at least one supplemental lock bar selectively movable from its locked position to its unlocked position by movement of said coupler frame to a select angular position relative to an associated excavator arm.

12. The coupler as set forth in claim 11, wherein said at least one supplemental lock bar includes an inner end including a lock face adapted to engage said lock member when said at least one supplemental lock bar is in its locked position, said at least one supplemental lock bar further comprising a second end adapted to be contacted and moved by an associated excavator arm.

13. The coupler as set forth in claim 12, further comprising a spring that biases said at least one supplemental lock arm to its locked position.

14. The coupler as set forth in claim 13, further comprising a stop connected to said frame, said inner end of said at least one supplemental lock bar contacting said stop when said at least one supplemental lock bar is located in its locked position.

15. The coupler as set forth in claim 12, wherein said lock member contacts and blocks movement of said at least one supplemental lock arm from its unlocked position to its locked position when said lock member is in its retracted position.

16. A coupler for a construction attachment, said coupler comprising:

a frame adapted to be releasably coupled to a construction attachment;

said frame comprising a first hook adapted to receive a first associated attachment pin and comprising a second hook adapted to receive a second attachment pin;

a lock member movable relative to the frame, said lock member movable between a locked position and an unlocked position, said first and second hooks including respective open mouths and said lock member obstructing said open mouth of said second hook when said lock member is in said locked position;

an actuator operably connected to the lock member and adapted to move the lock member between its locked and unlocked positions;

wherein said lock member first slides linearly and then pivots relative to said frame when moved by said actuator from said locked position to said unlocked position; and, wherein said lock member first pivots and then slides linearly relative to said frame when moved by said actuator from said unlocked position to said locked position.

* * * * *